US006309246B1

(12) United States Patent
Keaton et al.

(10) Patent No.: US 6,309,246 B1
(45) Date of Patent: Oct. 30, 2001

(54) PROTECTIVE RF TERMINATOR CAP

(75) Inventors: Jeffrey L. Keaton; Robert Vu; Rodney J. Poole, all of Houston; Martin Andrew Van Vuuren, Spring, all of TX (US); Norman Epstein, St. Lucie West, FL (US)

(73) Assignee: Telxon Corporation, Holtsville, NY (US)

( * ) Notice: Subject to any disclaimer, the term of this patent is extended or adjusted under 35 U.S.C. 154(b) by 0 days.

(21) Appl. No.: 09/652,181

(22) Filed: Aug. 31, 2000

(51) Int. Cl.[7] ..... H01R 31/08

(52) U.S. Cl. ..... 439/509; 333/125; 439/521; 439/149; 439/134

(58) Field of Search ..... 439/149, 134, 439/135, 521, 509; 333/125, 21 R, 254

(56) References Cited

U.S. PATENT DOCUMENTS

| | | | | |
|---|---|---|---|---|
| 3,605,041 | * | 9/1971 | Judkins | 333/125 |
| 4,258,970 | | 3/1981 | Bourdon et al. | 439/149 |
| 5,435,736 | | 7/1995 | McMills et al. | 439/133 |
| 5,655,915 | | 8/1997 | McMills et al. | 439/133 |

* cited by examiner

*Primary Examiner*—Tho D. Ta
(74) *Attorney, Agent, or Firm*—Amin & Turocy, LLP

(57) ABSTRACT

A terminator cap is provided for terminating a wireless transmitter output connector, which is made from a composite material so as to provide an electrical impedance between an outer case and a center conductor of the output connector. A method is also provided for terminating a wireless transmitter output connector.

21 Claims, 4 Drawing Sheets

PROTECTIVE RF TERMINATOR CAP

TECHNICAL FIELD

The present invention relates generally to wireless communications devices, and more particularly to a low cost protective terminator cap for such devices.

BACKGROUND OF THE INVENTION

In recent years, the use of wireless communication systems having mobile transceivers which communicate with a hardwired network, such as a local area network (LAN) or a wide area network (WAN), has become widespread. The mobile transceivers, commonly referred to as portable teletransaction computing devices (PTC) or mobile terminals, may take one of several different forms. For instance, in retail stores hand-held scanning units may be used to allow for scanning inventory bar codes. In a warehouse, portable units mounted to a vehicle may be used to gather information from the warehouse floor. In a medical environment, the mobile terminal may take the form of a pen based workslate which allows medical personnel to work with full page screens.

In a typical wireless communication system, each mobile terminal communicates with a networked system via a radio link in order to allow for a real time exchange of information. The mobile terminals communicate through one of several base stations interconnected to the network. The base stations allow for a wireless data communication path to be formed. Consequently, such mobile terminals significantly facilitate worker efficiency since data can be gathered, transmitted and even processed at a remote site in real time.

When constructing a typical mobile terminal, an effort is made to minimize overall size and weight while maximizing the device's processing power and memory storage. Such devices typically include a transmitter antenna adapted for removable connection to the terminal. The antenna is usually detached during assembly at a manufacturing site, and during shipment to a customer. Such an antenna provides a known impedance to the transmitter output for impedance matching and to provide a known load to an amplifier stage of the output. However, when a customer receives and unpacks such a device, he/she may load software programs into or otherwise configure the terminal transmitter device without first installing an antenna to the output connector. This operation without an antenna load may subject the output amplifier state to damage or degradation.

In addition, operation of the transmitter output stage without an antenna frequently occurs during assembly of the mobile terminal. Operation of the transmitter in this fashion without a proper load may result in damage to the output stage. However, connection of an antenna to the unit throughout assembly and/or shipment makes the unit difficult to handle, and requires larger capacity shipping containers or packaging, due to protrusion of the antenna beyond the transmitter device profile. Moreover, the time it takes to screw on an antenna, and to later remove the antenna for shipping adds cost. Thus, there is a need for a device and methodology for providing a load to wireless communications devices in a cost effective manner, which may be advantageously employed during assembly and shipment of such devices, and which prevents inadvertent electrical and/or mechanical damage to the output stage and output connector.

SUMMARY OF THE INVENTION

The present invention provides a terminator cap for terminating an output connector of wireless communication devices, such as portable teletransaction computing devices (PTC) or mobile terminals. The cap is manufactured from a conductive polymer or other composite material in order to provide a known electrical impedance between terminals of the output connector, whereby a low cost disposable load is provided, which may be easily installed on a wireless communication device during assembly and shipment. The invention thus minimizes the chance that the device will be operated without an output load, thereby preventing unnecessary damage to the device output stage circuitry.

In accordance with one aspect of the present invention, there is provided a terminator cap for terminating a wireless transmitter output connector with a connection end exposing a center conductor and a side portion including an outer case. The terminator cap comprises a first portion adapted to cover at least a portion of the connection end of the output connector, a second portion electrically connected to the first portion and adapted to cover at least a portion of the side portion of the output connector and to engage the outer case of the output connector, and a third portion electrically connected to the first portion and adapted to engage the center conductor of the output connector. The cap may be a push on device, allowing fast installation and removal from an antenna output connector. The first, second, and third portions may be made from a composite material adapted to provide an electrical impedance between the center conductor and the outer case of the output connector. In this regard, the material used in making the cap and/or the cap dimensions may advantageously be adjusted to control the impedance provided by the terminator cap.

The composite material may be a conductive polymer, and the electrical impedance provided between the center conductor and the outer case of the output conductor may be one of about 50 ohms, 75 ohms, 93–125 ohms, and 300 ohms. Thus, the invention contemplates terminator caps which may match the appropriate impedance of any number of standard transmitter output stages. In addition, the terminator cap may be advantageously adapted to engage with standard output connectors, such as MCX, an SMA, an SMB, a BNC, a TNC, and an RSMA connectors.

In this regard, the outer case of the output connector may include a curved conductive outer surface radially disposed from the center conductor, wherein the second portion of the terminator cap includes a radial inner surface adapted to receivingly engage the curved conductive outer surface. The cap thus provides mechanical protective cover for the output connector as well as an electrical load impedance. In addition, the center conductor of the output connector may include a generally cylindrical outer surface, wherein the third portion includes a generally radial inner surface adapted to receivingly engage the center conductor of the output connector.

Where the material used is sufficiently pliable, for example, through adjustment of the material durometer, the cap may be installed onto output connector types having threaded, bayonetted, or other types of engagement mechanisms. In this regard, the radial inner surface of the second portion may be adapted to provide an interference fit with the outer surface of the outer case and the third portion radial inner surface may be adapted to provide an interference fit with the center conductor. In this way, electrical connection may be established between the cap and the outer case and the center conductor of the output connection, with the cap itself providing an electrical impedance therebetween.

According to another aspect of the invention, a method is provided for terminating a wireless transmitter output connector, comprising providing a terminator cap having a first portion made from a composite material to provide an electrical impedance between second and third portions electrically connected to the first portion, engaging the first portion of the terminator cap with the output connector so as to cover at least a portion of a connection end of the output connector, engaging the second portion of the terminator cap with an outer case of the output connector and engaging the third portion of the terminator with a center conductor of the output connector. In this way, an electrical impedance is provided between the outer case and the center conductor of the output connector. The composite material may be a conductive polymer, adapted to provide a useful impedance, such as 50 ohms, 75 ohms, 93–125 ohms, or 300 ohms.

According to yet another aspect of the invention, a terminator cap is provided for terminating a wireless transmitter output connector, which comprises covering means for covering at least a portion of a connection end of the output connector, first engagement means for engaging an outer case of the output connector, and second engagement means for engaging a center conductor of the output connector. At least one of the covering means and the first and second engagement means may be made from a conductive polymer wherein the covering means and the first and second engagement means are adapted to provide an electrical impedance between the outer case and the center conductor of the output connector.

To the accomplishment of the foregoing and related ends, certain illustrative aspects and implementations of the present invention are hereinafter described with reference to the attached drawing figures. The following description and the annexed drawings set forth in detail certain illustrative applications and aspects of the invention. These are indicative, however, of but a few of the various ways in which the principles of the invention may be employed. Other aspects, advantages and novel features of the invention will become apparent from the following detailed description of the invention when considered in conjunction with the drawings.

DETAILED DESCRIPTION OF THE INVENTION

Figure 1A:
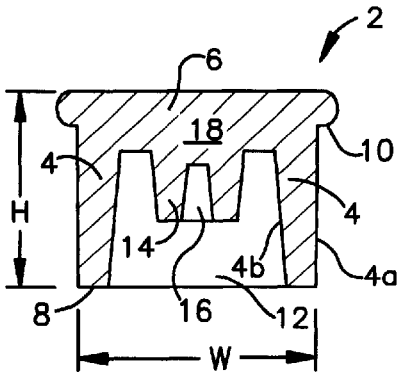
FIG. 1A is a side elevation view in section of an exemplary terminator cap taken along line 1A—1A of FIG. 1B in accordance with the present invention.

The present invention will now be described with reference to the drawings, wherein like reference numerals are used to refer to like elements throughout. It should be understood that the description of these features are merely illustrative and that they should not be taken in a limiting sense. The invention includes a low cost protective terminator cap for terminating a wireless transmitter output connector, which is made from a composite material so as to provide an electrical impedance between an outer case and a center conductor of the output connector.

The invention thus provides protection for the output connector against external mechanical damage, as well as against damage to the transmitter output stage due to operation with an improper load. In addition, the terminator cap is inexpensive, easy to install, and fits easily into existing transmitter terminal packaging. While off the shelf terminator caps have been heretofore available, these are precision machined parts, costing several dollars apiece. Consequently, the inclusion of such conventional terminator caps with each transmitter device is cost prohibitive. The invention further provides a method for terminating a wireless transmitter output connector.

Figure 1B:
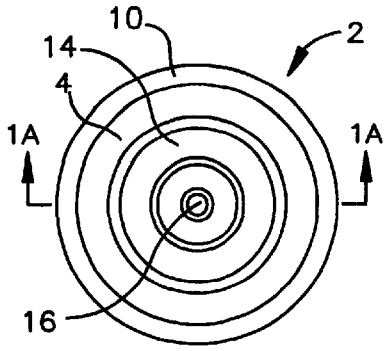
FIG. 1B is a bottom plan view of the terminator cap of FIG. 1A.

Referring now to FIGS. 1A and 1B, an exemplary terminator cap 2 is illustrated having a cylindrical outer portion 4 extending downwardly from a cylindrical top portion 6 to a bottom end 8. The top portion 6 includes an outwardly extending lip 10 which may aid in removal of the cap 2 from a transmitter output connector, as illustrated and described in greater detail infra. The cylindrical outer portion 4 includes outer and inner surfaces 4*a* and 4*b*, respectively, wherein the inner surface 4*b* defines a cylindrical inner cavity 12 and is adapted for engaging and covering an outer case of an output connector. Inner and outer surfaces 4*a* and 4*b* may be set at a draft angle, for example, one half to two degrees from the vertical, in order to allow for ease of manufacture using a mold.

Within the cavity 12, the cap 2 further includes a cylindrical inner portion 14 extending downwardly from an inner surface of top portion 6 toward the bottom end 8. The cylindrical inner portion 14 includes a centrally located vertically extending cylindrical cavity 16 adapted to engage a central conductor of an output connector, as described infra. The inner and outer surfaces of portion 14 may also be drafted at a slight angle. In addition, the thickness of the various portions of the cap 2 may be advantageously sized to facilitate filling of a mold during manufacture and to prevent sinks therein.

The top portion 6, cylindrical outer portion 4 and cylindrical inner portion 14 may be made of a composite material 18 adapted to provide an electrical impedance between an output connector center conductor and outer case, whereby a load is provided to the output amplifier stage of a transmitter device, such as a wireless transmitter terminal. According to an aspect of the invention, for example, the composite material may be a conductive polymer adapted to provide an impedance of 50, 75, 93–125, or 300 ohms, although it will be appreciated that other impedances are possible and are contemplated as falling within the scope of the invention.

The material 18 along with the dimensions of the cap 2 may be adjusted in order to provide any impedance between the portions 4 and 14 as desired for a given transmitter device. For example, the exemplary protective terminator cap of FIGS. 1A and 1B may have a height H of approximately 0.30 inches and a width W of approximately 0.37 inches, in order to engage with an RSMA output connector, although it will be appreciated that other shapes and dimensions are possible within the scope of the present invention.

In addition to the cap dimensions, the durometer of the material 18 may be chosen to provide for ease of installation and removal from an output connector. For example, the cap 2 may be made flexible enough to provide for interference fits between the portion 4 and a side portion or outer case of an output connector, as well as an interference fit between the portion 14 and a central conductor of such a connector.

In addition to providing a known output load to a transmitter device, the protective terminator cap 2 further guards against physical damage to the transmitter output connector, such as during assembly and/or shipment. It will be further recognized that the cap 2 provides a small profile compared with a transmitter output antenna, thereby allowing the use of the cap within existing assembly and testing fixtures, as well as shipment packaging.

Figure 2:
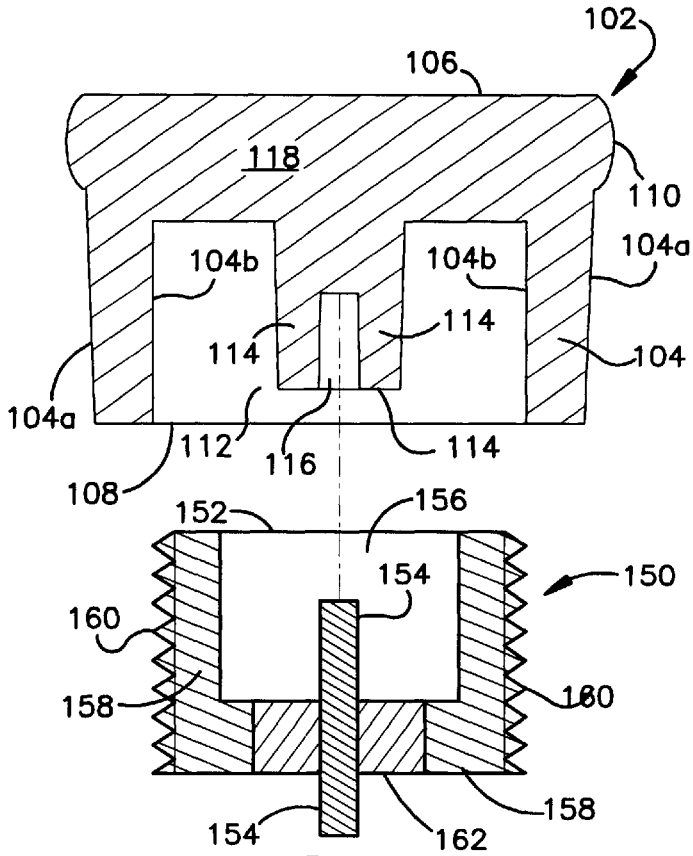
FIG. 2 is a side elevation view in section of another exemplary terminator cap in accordance with the invention, along with an output connector.

Referring now to FIG. 2, another exemplary terminator cap 102 is illustrated in section according to another aspect of the invention, along with an exemplary transmitter device output connector 150. The exemplary terminator cap 102 includes a cylindrical outer portion 104 extending downwardly from a cylindrical top portion 106 to a bottom end 108. Top portion 106 includes an outwardly extending lip 110 which may aid in removal of the cap 102 from the transmitter output connector 150. The cylindrical outer portion 104 includes outer and inner surfaces 104*a* and 104*b*, respectively. The inner surface 104*b* defines a cylindrical inner cavity 112 and is adapted for engaging and covering an outer case of an output connector. Within cavity 112, the cap 102 further includes a cylindrical inner portion 114 extending downwardly from an inner surface of top portion 106 toward the bottom end 108. The cylindrical inner portion 114 includes a centrally located vertically extending cylindrical cavity 116 adapted to engage a central conductor of an output connector, as described infra.

The top portion 106, cylindrical outer portion 104 and cylindrical inner portion 114 may be made of a composite material 118 adapted to provide an electrical impedance between an output connector center conductor and outer case, whereby a load is provided to the output amplifier stage of a transmitter device, such as a wireless transmitter terminal. According to an aspect of the invention, for example, the composite material may be a conductive polymer adapted to provide an impedance of 50, 75, 93–125, or 300 ohms, although it will be appreciated that other impedances are possible and are contemplated as falling within the scope of the invention.

The material 118 along with the dimensions of the cap 102 may be adjusted in order to provide any impedance between the portions 104 and 114 as desired for a given transmitter device. In addition, the durometer of the material 118 may be chosen to provide for ease of installation and removal from an output connector. For example, the cap 102 may be made flexible enough to provide for interference fits between the portion 104 and a side portion or outer case of an output connector, as well as an interference fit between the portion 114 and a central conductor of such a connector. In addition, the protective terminator cap 102 may be adapted to prevent or minimize physical damage to the transmitter output connector, such as during assembly and/or shipment. Cap 102 furthermore provides a small profile compared with a transmitter output antenna, thereby allowing the use of the cap within existing assembly and testing fixtures, as well as shipment packaging.

Cap 102 may be advantageously employed in covering a transmitter device output connector, such as connector 150, which includes a connection end 152 exposing a center conductor 154 within a cavity 156 defined by a cylindrical side portion 158 having a conductive outer case 160, for example, made of steel. The connector 150 may further include an insulator 162 disposed between the side portion 158 and the center conductor 154, whereby the transmitter output signal may be carried, for example, on the center conductor 154 with respect to the side portion 158, to an antenna or other load connected to the connector 150.

Figure 3:
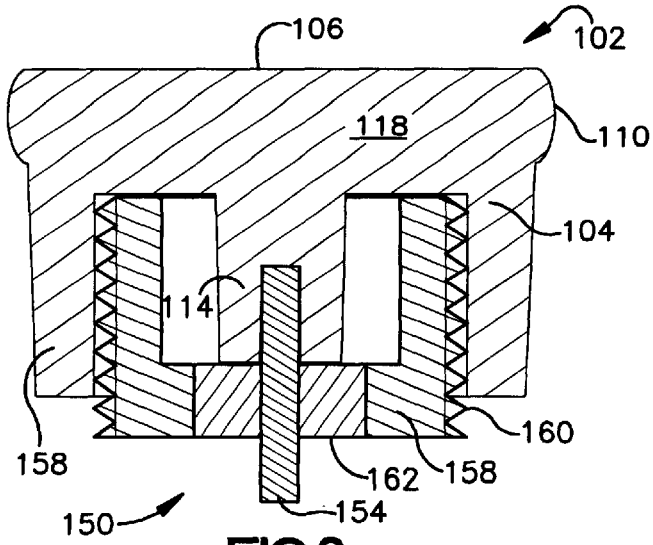
FIG. 3 is a side elevation view in section of the exemplary terminator cap of FIG. 2 engaged with an output connector.

The terminator caps 2 and 102 may be employed in protecting and providing a load to a variety of standard transmitter output connectors, such as MCX, SMA, SMB, BNC, TNC, and RSMA type connectors. Referring also to FIG. 3, the cap 102 may be installed on connector 150 such that electrical connections are established between the cap portion 104 and the connector outer case 160, as well as between the cap portion 114 and the output connector center conductor 154. For example, the durometer of cap 102 may be such that interference fits are established between the cap portion 104 and the connector outer case 160, as well as between the cap portion 114 and the output connector center conductor 154. In this regard, it will be appreciated that although the exemplary connector 150 is illustrated having a threaded outer case 160, that the cap 102 may be advantageously employed with other types of connectors, for example, those having snap fittings, bayonets, and the like, within the scope of the present invention.

By constructing the cap 102 from a composite material 118 such as a conductive polymer, cap 102 provides a known electrical impedance between the outer case 160 and the conductor 154, thereby establishing a load to an output amplifier stage of a transmitter device. Thus, if a customer operates the transmitter (e.g., while loading software therein or otherwise performing initial setup thereof) prior to installing an antenna onto the connector 150, the transmitter output stage will not be damaged by improper loading. The cap further provides a load where such a transmitter device is operated without an antenna during assembly or testing at a manufacturing site. Further more, the cap may be cost effectively manufactured, for example, via a molding process, whereby a cap 102 may be installed and shipped with every transmitter device.

Figure 4A:
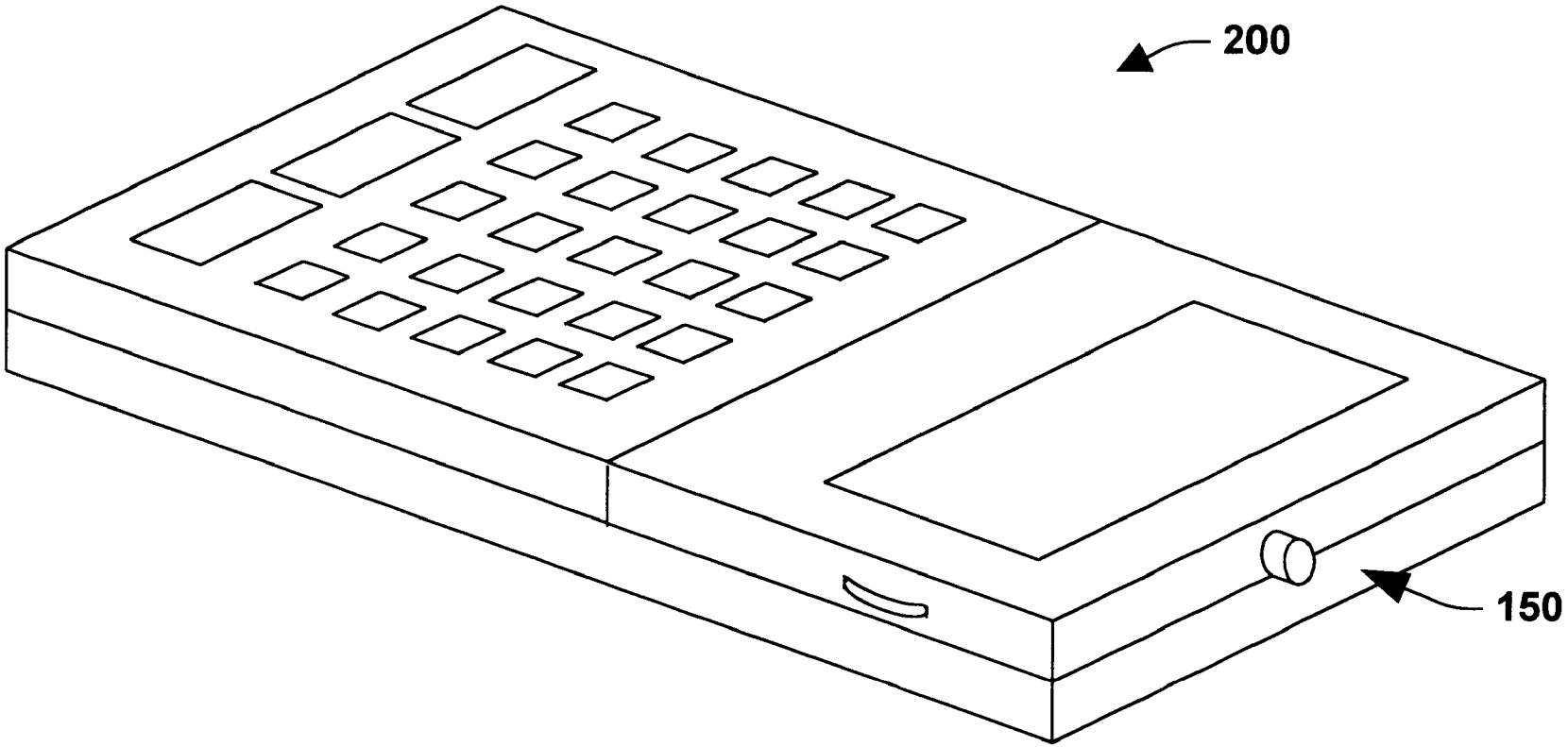
FIG. 4A is a perspective view of an exemplary transmitter device having an output connector adapted for removable engagement with an antenna.
Figure 4B:
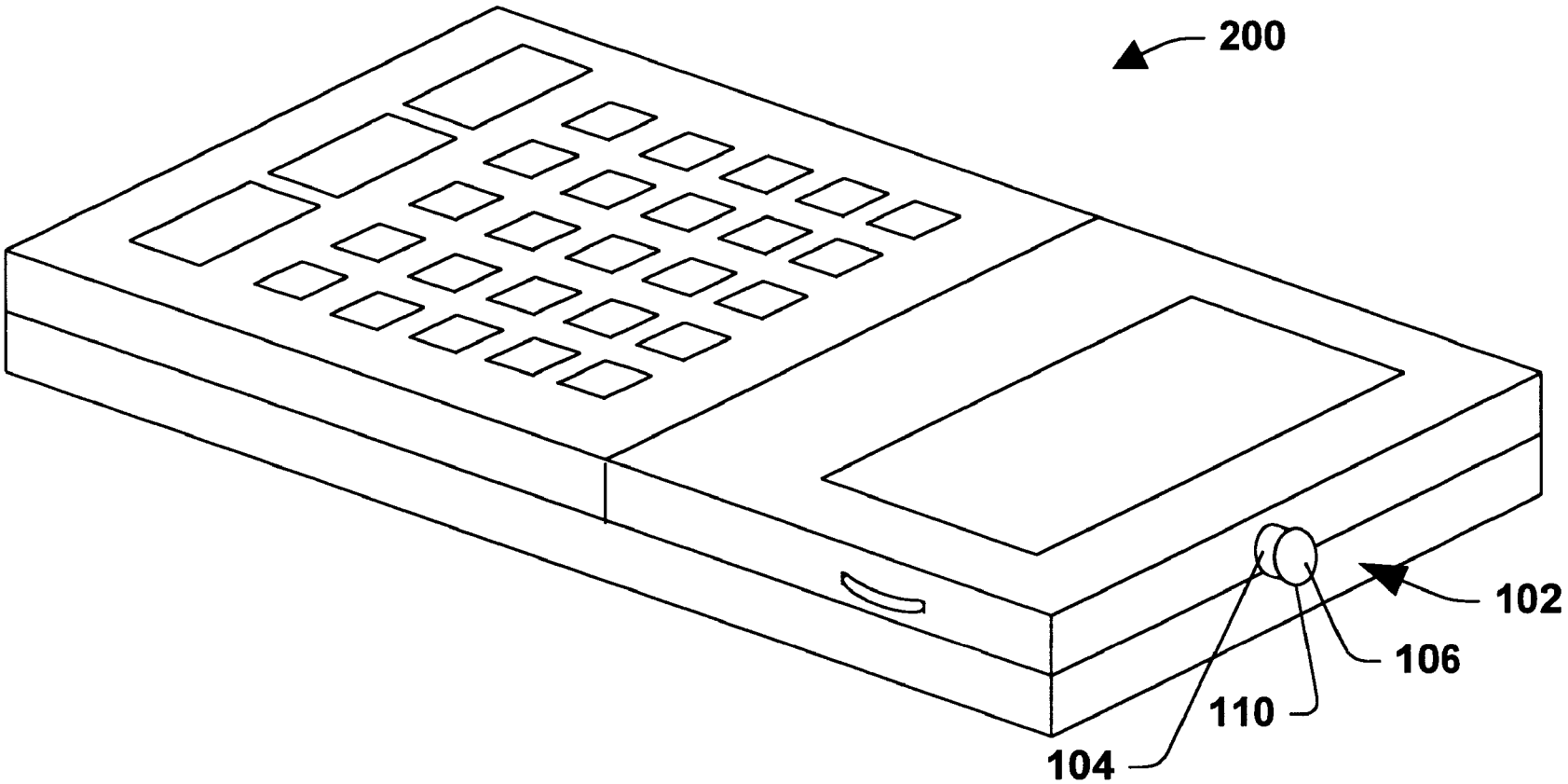
FIG. 4B is a perspective view of the transmitter device of FIG. 4A and an exemplary protective terminator cap engaged with the output connector in accordance with the invention.

During shipment, moreover, the cap 102 provides a low profile protective covering for the output connector 150, which may be easily fit into existing shipment packaging for a transmitter device. Referring now to FIGS. 4A and 4B, a transmitter 200 is illustrated having an output connector 150 adapted to receivingly engage a transmitter antenna (not shown). Such devices 200 are typically packaged and shipped (as well as handled during assembly and testing) without an antenna installed, as illustrated in FIG. 4A. A protective terminator cap 102 is installed onto the output connector 150, as illustrated in FIG. 4B, which adds a minimal overhang relative to the overall size of the device 200. Thus, the protective cap 102 provides a smaller profile than do standard antennas typically used with such transmitters, enabling the provision of an inexpensive disposable protective cover for at least a portion of the output connector, as well as an electrical load therefor. The invention thus provides a cost effective solution without forcing the transmitter devices to be shipped with an antenna installed.

Figure 5:
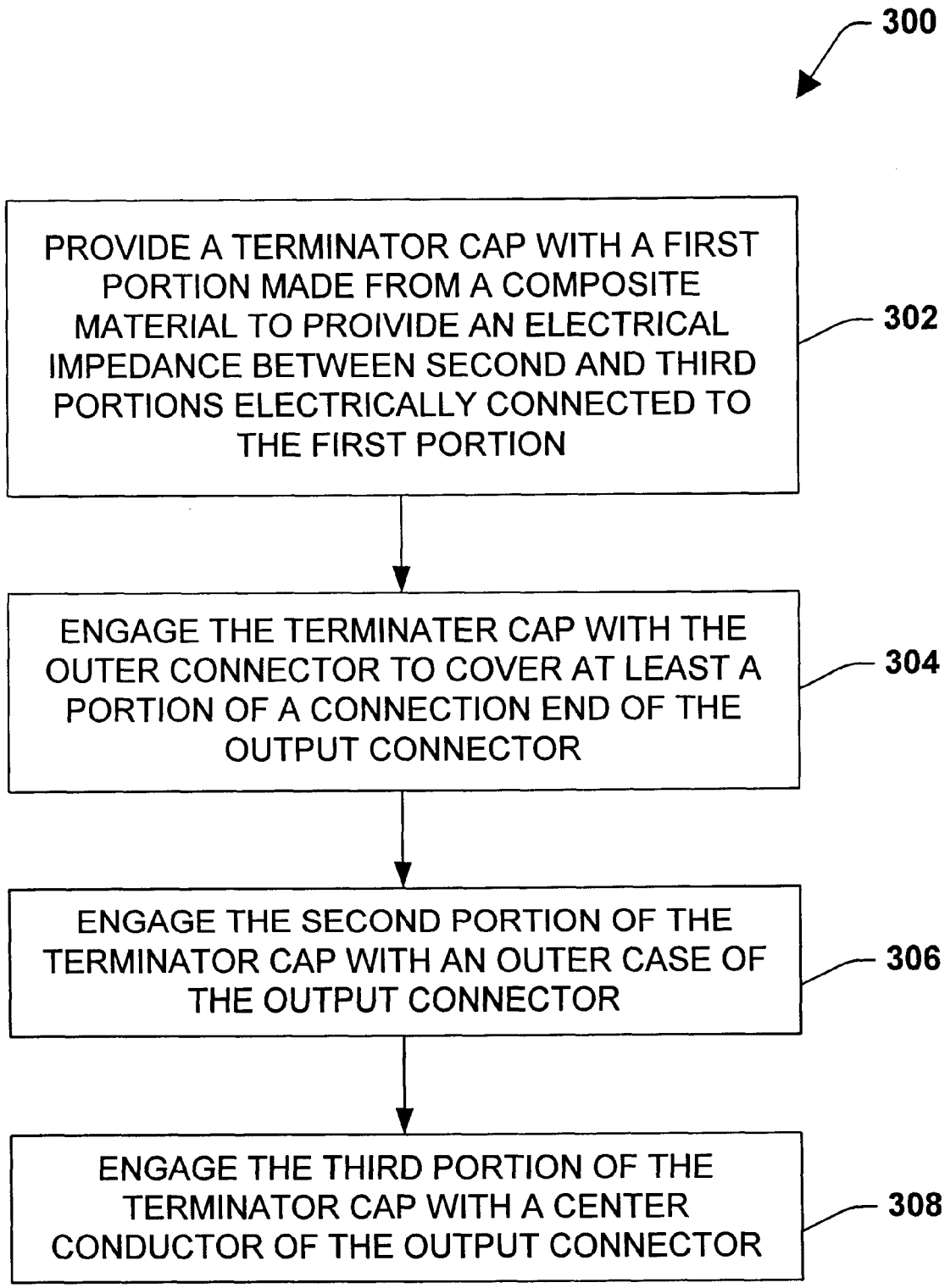
FIG. 5 is a flow diagram illustrating an exemplary method of terminating a transmitter device output connector.

Referring now to FIG. 5, the invention further provides a method 300 of terminating a wireless transmitter output connector. Beginning at step 302, a terminator cap (e.g., cap 2 or 102) is provided having a first portion made from a composite material to provide an electrical impedance between second and third portions electrically connected to the first portion. The first portion of the terminator cap is then engaged with the output connector at step 304 so as to cover at least a portion of a connection end of the output connector, and the second portion is engaged with an outer case of the output connector at step 306. At step 308, the third portion of the terminator cap is engaged with a center conductor of the output connector. By this method 300, an electrical impedance is advantageously provided between the outer case and the center conductor of the output connector, in addition to providing protection for the connector itself.

Although the invention has been shown and described with respect to a certain aspects and implementations, it will be appreciated that equivalent alterations and modifications will occur to others skilled in the art upon the reading and understanding of this specification and the annexed drawings. In particular regard to the various functions performed by the above described components (assemblies, devices, circuits, systems, etc.), the terms (including a reference to a "means") used to describe such components are intended to correspond, unless otherwise indicated, to any component which performs the specified function of the described component (i.e., that is functionally equivalent), even though not structurally equivalent to the disclosed structure, which performs the function in the herein illustrated exemplary aspects of the invention. In addition, while a particular feature of the invention may have been disclosed with respect to only one of several implementations, such feature may be combined with one or more other features of the other aspects as may be desired and advantageous for any given or particular application. Furthermore, to the extent that the terms "includes", "including", "has", "having", and variants thereof are used in either the detailed description or the claims, these terms are intended to be inclusive in a manner similar to the term "comprising."

What is claimed is:

1. A terminator cap for terminating a wireless transmitter output connector with a connection end exposing a center conductor and a side portion including an outer case, the terminator cap comprising:

a first portion covering at least a portion of the connection end of the output connector;

a second portion electrically connected to the first portion and covering at least a portion of the side portion of the output connector and engaging the outer case of the output connector; and a third portion electrically connected to the first portion and engaging the center conductor of the output connector, the third portion being in a fixed location relative to the second portion;

wherein the first, second, and third portions are made from a composite material providing a known electrical load impedance between the center conductor and the outer case of the output connector.

2. The terminator cap of claim 1, wherein the electrical impedance provided between the center conductor and the outer case of the output conductor is one of 50 ohms, 75 ohms, 93 ohms, 125 ohms, and 300 ohms.

3. The terminator cap of claim 1, wherein the electrical impedance provided between the center conductor and the outer case of the output conductor is in the range of about 93 to 125 ohms.

4. The terminator cap of claim 1, wherein the electrical impedance provided between the center conductor and the outer case of the output conductor is about 50 ohms.

5. The terminator cap of claim 1, wherein the output connector is one of an MCX, an SMA, an SMB, a BNC, a TNC, and an RSMA connector.

6. The terminator cap of claim 1, wherein the outer case of the output connector includes a curved conductive outer surface radially disposed from the center conductor and wherein the second portion includes a radial inner surface adapted to receivingly engage the curved conductive outer surface.

7. The terminator cap of claim 1, wherein the center conductor of the output connector includes a generally cylindrical outer surface and wherein the third portion includes a generally radial inner surface adapted to receivingly engage the center conductor of the output connector.

8. The terminator cap of claim 1, wherein the composite material is a conductive polymer.

9. The terminator cap of claim 8, wherein the electrical impedance provided between the center conductor and the outer case of the output conductor is one of 50 ohms, 75 ohms, 93 ohms, 125 ohms, and 300 ohms.

10. The terminator cap of claim 8, wherein the electrical impedance provided between the center conductor and the outer case of the output conductor is in the range of about 93 to 125 ohms.

11. The terminator cap of claim 8, wherein the electrical impedance provided between the center conductor and the outer case of the output conductor is about 50 ohms.

12. The terminator cap of claim 11, wherein the output connector is one of an MCX, an SMA, an SMB, a BNC, a TNC, and an RSMA connector.

13. The terminator cap of claim 12, wherein the outer case of the output connector includes a curved conductive outer surface radially disposed from the center conductor and wherein the second portion includes a radial inner surface adapted to receivingly engage the curved conductive outer surface.

14. The terminator cap of claim 13, wherein the center conductor of the output connector includes a generally cylindrical outer surface and wherein the third portion includes a generally radial inner surface adapted to receivingly engage the center conductor of the output connector.

15. The terminator cap of claim 14, wherein the radial inner surface of the second portion provides an interference fit with the curved conductive outer surface of the outer case and wherein the third portion radial inner surface provides an interference fit with the generally cylindrical outer surface of the center conductor.

16. A method of terminating a wireless transmitter output connector, comprising:

providing a terminator cap having a first portion made from a composite material to provide a known electrical load impedance between second and third portions electrically connected to the first portion, the second and third portions being located in fixed positions relative to one another;

engaging the terminator cap with the output connector so as to cover at least a portion of a connection end of the output connector;

engaging the second portion of the terminator cap with an outer case of the output connector; and engaging the third portion of the terminator cap with a center conductor of the output connector;

whereby an electrical load impedance is provided between the outer case and the center conductor output connector.

17. The method of claim 16, wherein the composite material is a conductive polymer.

18. The method of claim 17, wherein the electrical impedance is one of 50 ohms, 75 ohms, 93 ohms, 125 ohms, and 300 ohms.

19. The method of claim 18, wherein the electrical impedance is about 50 ohms.

20. A terminator cap for terminating a wireless transmitter output connector, comprising:

covering means for covering at least a portion of a connection end of the output connector;

first engagement means for engaging an outer case of the output connector; and second engagement means for engaging a center conductor of the output connector;

at least one of the covering means and the first and second engagement means comprising a conductive polymer, the covering means and the first and second engagement means providing a known electrical load impedance between the outer case and the center conductor of the output connector, and the first and second engagement means being in fixed relative positions.

21. A terminator cap for terminating a wireless transmitter output connector with a connection end exposing a center conductor and a side portion including an outer case, the terminator cap comprising:

a first portion covering at least a portion of the connection end of the wireless transmitter output connector;

a second portion electrically connected to the first portion and covering at least a portion of the side portion of the wireless transmitter output connector and engaging the outer case of the wireless transmitter output connector; and a third portion electrically connected in a fixed relationship to the second portion and engaging the center conductor of the wireless transmitter output connector;

wherein the first, second, and third portions are made from a conductive polymer composite material providing a known output load between the center conductor and the outer case of the wireless transmitter output connector.

* * * * *